US007231978B2

(12) United States Patent
Rivas et al.

(10) Patent No.: US 7,231,978 B2
(45) Date of Patent: Jun. 19, 2007

(54) CHEMICAL INJECTION WELL COMPLETION APPARATUS AND METHOD

(75) Inventors: Olegario Rivas, Tulsa, OK (US); Jose Ernesto Jaua, Estado Zulia (VE); Hendry Lopez, Ciudad Del Carmen (MX)

(73) Assignee: Schlumberger Technology Corporation, Sugar Land, TX (US)

( * ) Notice: Subject to any disclaimer, the term of this patent is extended or adjusted under 35 U.S.C. 154(b) by 186 days.

(21) Appl. No.: 11/109,390

(22) Filed: Apr. 19, 2005

(65) Prior Publication Data

US 2006/0231256 A1 Oct. 19, 2006

(51) Int. Cl.
*E21B 43/116* (2006.01)
*E21B 43/27* (2006.01)

(52) U.S. Cl. ..... 166/297; 166/369; 166/106; 166/305.1

(58) Field of Classification Search ..... 166/297, 166/369, 305.1, 55.1, 105, 106, 149
See application file for complete search history.

(56) References Cited

U.S. PATENT DOCUMENTS 4,898,244 A * 2/1990 Schneider et al. ..... 166/297
4,917,189 A * 4/1990 George et al. ..... 166/297
5,971,072 A 10/1999 Huber et al.
6,079,491 A * 6/2000 Stuebinger et al. ..... 166/266
6,119,780 A * 9/2000 Christmas ..... 166/313
6,250,390 B1 * 6/2001 Narvaez et al. ..... 166/369
6,325,143 B1 * 12/2001 Scarsdale ..... 166/54.1
6,684,956 B1 * 2/2004 Berry ..... 166/313
6,732,798 B2 5/2004 Johnson et al.
6,874,579 B2 4/2005 Johnson et al.
2004/0129419 A1 * 7/2004 Van Wulfften Palthe .... 166/278

* cited by examiner

*Primary Examiner*—David Bagnell
*Assistant Examiner*—David Andrews
(74) *Attorney, Agent, or Firm*—Chyau Liang; Bryan P. Galloway; Tim Curington

(57) ABSTRACT

An apparatus to be disposed within a wellbore includes a production tubing in communication with a pump string and a bypass string at its distal end, wherein the pump string is configured to pump a wellbore fluid to a surface location through the production tubing, wherein the bypass string includes an upper fluid gate, a packer and a lower fluid gate, wherein the upper and the lower fluid gates are configured to selectively allow or disallow fluid communication with a bore of the bypass string, wherein the upper fluid gate is positioned above the packer and the lower fluid gate is positioned below the packer. The apparatus includes a check valve to prevent reverse fluid communication from the production tubing to the pump string.

31 Claims, 6 Drawing Sheets

CHEMICAL INJECTION WELL COMPLETION APPARATUS AND METHOD

BACKGROUND OF THE INVENTION

Completion of and production from a subterranean wellbore typically involves numerous steps. Usually, the wellbore is first drilled, cased, and cemented to ensure fluids produced from the subterranean formation make it to the surface as efficiently as possible. Next, a process known as perforation creates a plurality of apertures in the cased and cemented wellbore to allow hydrocarbons in the production zone formation to enter the wellbore. Because subterranean casing strings are usually constructed from steel tubing, perforating "guns" having explosive shape charges are often deployed for this purpose. These charges, when detonated, pierce the casing, cement, and formation, thereby allowing the hydrocarbons to flow into the wellbore. Often, merely piercing the casing is not enough to produce hydrocarbons from the formation in economically sufficient quantities. Frequently, additional operations are performed to inject stimulating chemicals into the formation. Once the flow of production fluids into the bore of the cased wellbore is sufficient to justify the cost of drilling and maintaining the well, production systems including various pumps valves, and measurement devices are installed to transfer the hydrocarbons flowing from the formation to the surface.

Presently, the perforation and chemical injection processes are performed separately from and with different apparatuses than production because these processes are damaging to production system components. Particularly, the shock waves generated in explosive perforation and the harsh acids and other chemicals used in stimulation have a tendency to damage pump and valve assemblies in production systems. As such, perforation, stimulation, and production are often carried out separately with distinct components, each requiring a trip in and out of the borehole. Because the cost of rig time is at a premium, separate operations to perforate, fracture, stimulate, and produce a wellbore can be extremely expensive. As such, a need arises in the petroleum industry for a single assembly capable of perforating, stimulating, and producing a subterranean formation on a single trip into the wellbore. Such an assembly capable of performing all three (or even two out of the three) operations without damage to sensitive production components would be extremely well received by production companies.

SUMMARY OF THE INVENTION

An aspect of the invention relates to an apparatus to be disposed within a wellbore. An apparatus in accordance with one embodiment of the invention includes a production tubing in communication with a pump string and a bypass string at its distal end, wherein the pump string is configured to pump a wellbore fluid to a surface location through the production tubing, wherein the bypass string includes an upper fluid gate, a packer and a lower fluid gate, wherein the upper and the lower fluid gates are configured to selectively allow or disallow fluid communication with a bore of the bypass string, wherein the upper fluid gate is positioned above the packer and the lower fluid gate is positioned below the packer. The apparatus includes a check valve to prevent reverse fluid communication from the production tubing to the pump string.

DETAILED DESCRIPTION OF THE PREFERRED EMBODIMENTS

Figure 1:
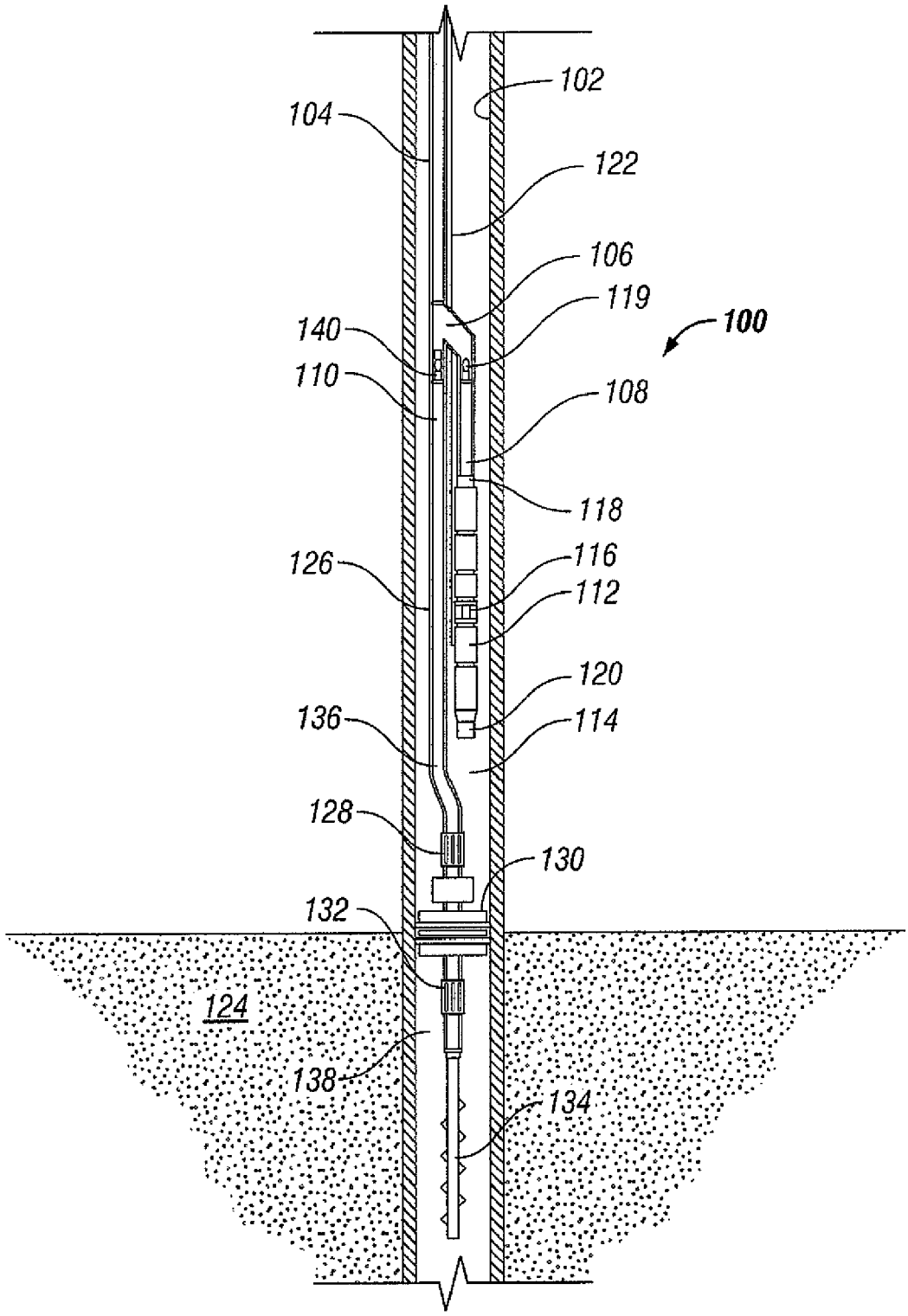
FIG. 1 is a schematic section-view drawing of a production apparatus in accordance with an embodiment of the present invention as deployed to a wellbore.

Referring initially to FIG. 1, a production apparatus 100 in accordance with embodiments of the present invention is shown. Production apparatus 100 is desirably deployed to a wellbore lined with casing 102 upon the end of a string of production tubing 104 extending from a surface station (not shown). Production tubing 104 terminates at its distal end into a Y-shaped union commonly known as a Y-tool 106. Below Y-tool 106 and in fluid communication with production tubing 104 are a pump string 108 and a bypass string 110. Furthermore, while a Y-tool 106 is shown, it should be understood by one of ordinary skill in the art that any style fluid union can be used to connect production tubing 104 with bypass string 110 and pump string 108.

Pump string 108 extends further into casing 102 and includes a pump assembly 112. Pump assembly 112 is preferably configured to pump wellbore fluids from upper region 114 of casing 102, up through production tubing 104, and to a surface station above the well. Pump assembly 112 may be constructed as an electric submersible pump that includes an inlet 116 and an outlet 118 in communication with pump string 108. A check valve 119 ensures that fluids (e.g. stimulating chemicals) from production tubing 104 and bypass string 110 will not flow into pump assembly 112 and potentially damage its inner components. Optionally, a sensor package 120 mounted to pump assembly 112 records and reports downhole conditions to a pump controller (not shown) or a surface station. Furthermore, a control and power line 122 extends from pump assembly 112, alongside production tubing 104 to a surface control station. Those having ordinary skill will appreciate that control and power line 122 may vary in construction depending on the pump assembly 112. For example, if pump assembly 112 is pressure driven, control and power line 122 may comprise one or more fluid conduits in communication with a surface pressure source and pump assembly 112.

Bypass string 110 preferably runs alongside pump string 108 inside casing 102 and extends deeper into a production zone 124. Bypass string 110 may include a bypass section 126, an upper fluid gate 128, a packer assembly 130, a lower fluid gate 132, and a perforating gun 134. Upper and lower fluid gates 128, 132 are devices designed to selectively allow and disallow fluids from outside bypass string 110 to communicate with a bore 136 of bypass string 110. Preferably, fluid gates 128 and 132 are constructed as sliding sleeve type devices, but any remotely operable fluid gate devices can be used. Packer 130 is expanded after production apparatus 100 is delivered to cased wellbore and acts to hydraulically seal off the annulus between bypass string 110 and cased wellbore and divide that annulus into upper 114 and lower regions 138. Perforating gun 134 can be of any type known in the art but is preferably a shape charge device configured to pierce casing 102 and perforate production zone 124 following detonation. A plug 140 capable of being set into and retrieved from bypass tubing 110 selectively allows or blocks off direct communication between bypass tubing 110 and production tubing 104. Plug 140 can either be a physical device deployed and retrieved through production tubing 104 from the surface or can be an electrically or hydraulically operable shutoff valve. Furthermore, if plug 140 is a remotely operable valve, it may be configured to allow large diameter items to pass therethrough when open. For example, a remotely operable flapper valve can be used for plug 140.

With both upper and lower fluid gates 128, 132 open, fluid communication between upper and lower regions 114 and 138 is permitted. With upper fluid gate 128 open and lower fluid gate 132 closed, only upper region 114 is in communication with production tubing 104 and pump assembly 112. With upper fluid gate 128 closed and lower fluid gate 132 open, only lower region 138 is in communication with production tubing 104. By selectively manipulating upper fluid gate 128, lower fluid gate 132, and plug 140, numerous operations can be performed on cased wellbore and production zone 124 without detrimental effect on pump assembly 112 or other production string components.

Figure 2:
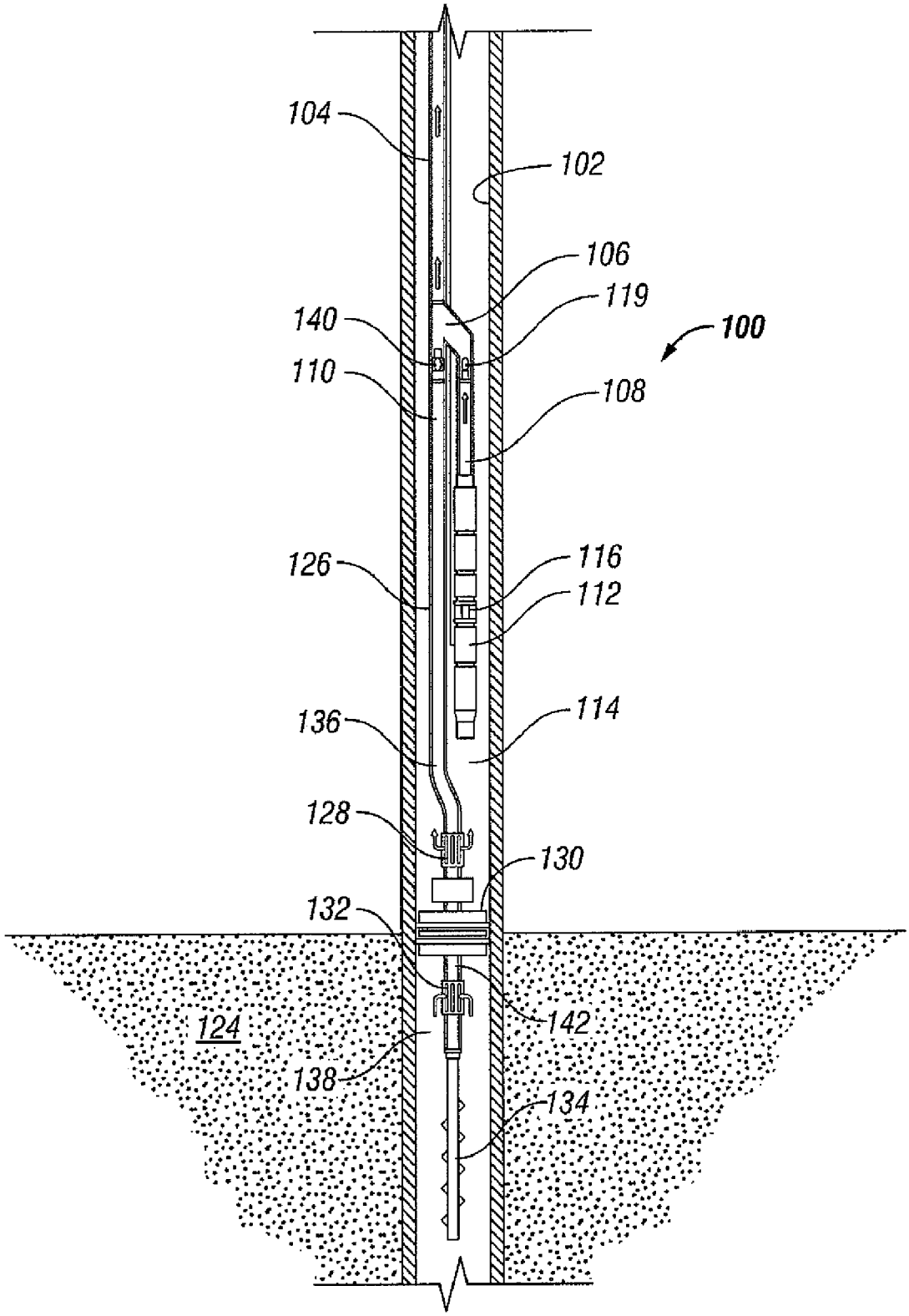
FIG. 2 is a schematic section-view drawing of the production apparatus of FIG. 1 creating an under-balanced condition in the wellbore.

Referring now to FIG. 2, an under-balanced pressure condition is created in regions 114 and 138 by production apparatus 100. It is believed than an under-balanced pressure condition is conducive to effective perforation of casing 102 and the surrounding production zone 124. With plug 140 set in place and upper and lower fluid gates 128, 132 opened, pump assembly 112 is activated and draws fluid from regions 114 and 138 into inlet 116, past check valve 119 and up production tubing string 104. With plug 140 set within bypass string 110 near Y-tool 106, wellbore fluids flow through a lower section 142 of bypass string extending between fluid gates 128, 132 and packer 130 between upper and lower zones 114, 138. When the pressure in region 138 adjacent to production zone 124 reaches a desirable under-balanced condition, plug 140 is retrieved, gates 128 and 132 are closed, and pump assembly 112 is shut off.

Figure 3:
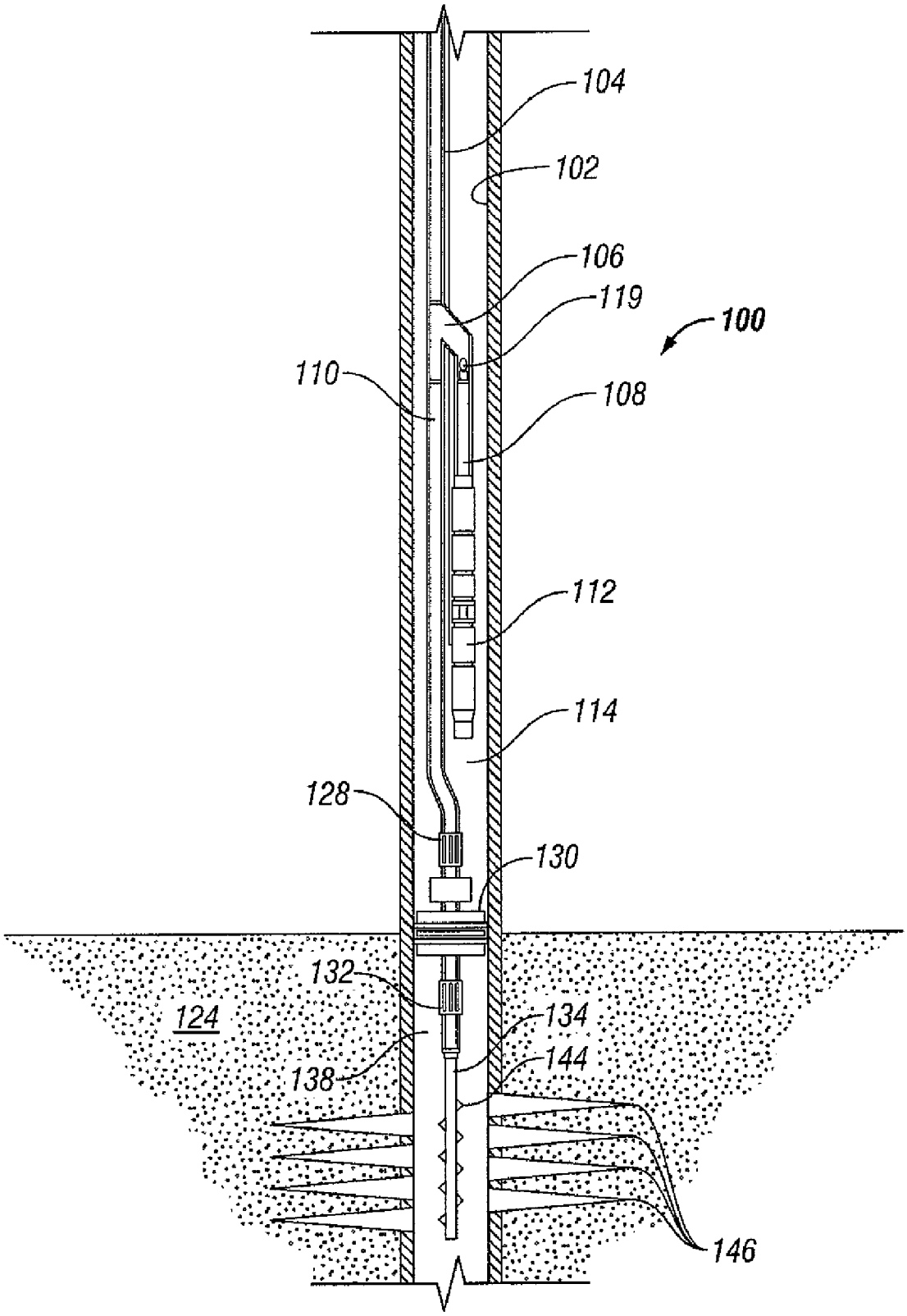
FIG. 3 is a schematic section-view drawing of the production apparatus of FIG. 1 during a perforating operation in the wellbore.

Referring to FIG. 3, perforating gun 134 is detonated and shape charges 144 create perforations 146 piercing casing 102 and formation at production zone 124. Perforations 146 allow fluids from production zone 124 to communicate with inner bore 138, 114 of casing 102. Detonation of shape charges 144 of perforating gun 134 can be accomplished through any means known to one of ordinary skill in the art including, but not limited to, electrical, hydraulic, or mechanical energy activation. Such activation can be carried out through an auxiliary conduit (not shown) extending alongside production tubing 104 and bypass string 110 or through the production tubing 104 itself. Additionally, presuming a relatively straight and clear path through the bores of production tubing 104, Y-tool 106 and bypass string 110, weight bars can be dropped from the surface through said bores to detonate perforating gun 134, if so configured. Regardless of the detonation mechanism used, packer 130 and closed fluid gates 128, 132 effectively reduce the amount of shock experienced by pump assembly 112 resulting from that detonation. Therefore, delicate, high-tolerance components of pump assembly 112 are less likely to be damaged by the detonation of perforating gun 134 when pump assembly 112 is in cased wellbore.

Figure 4:
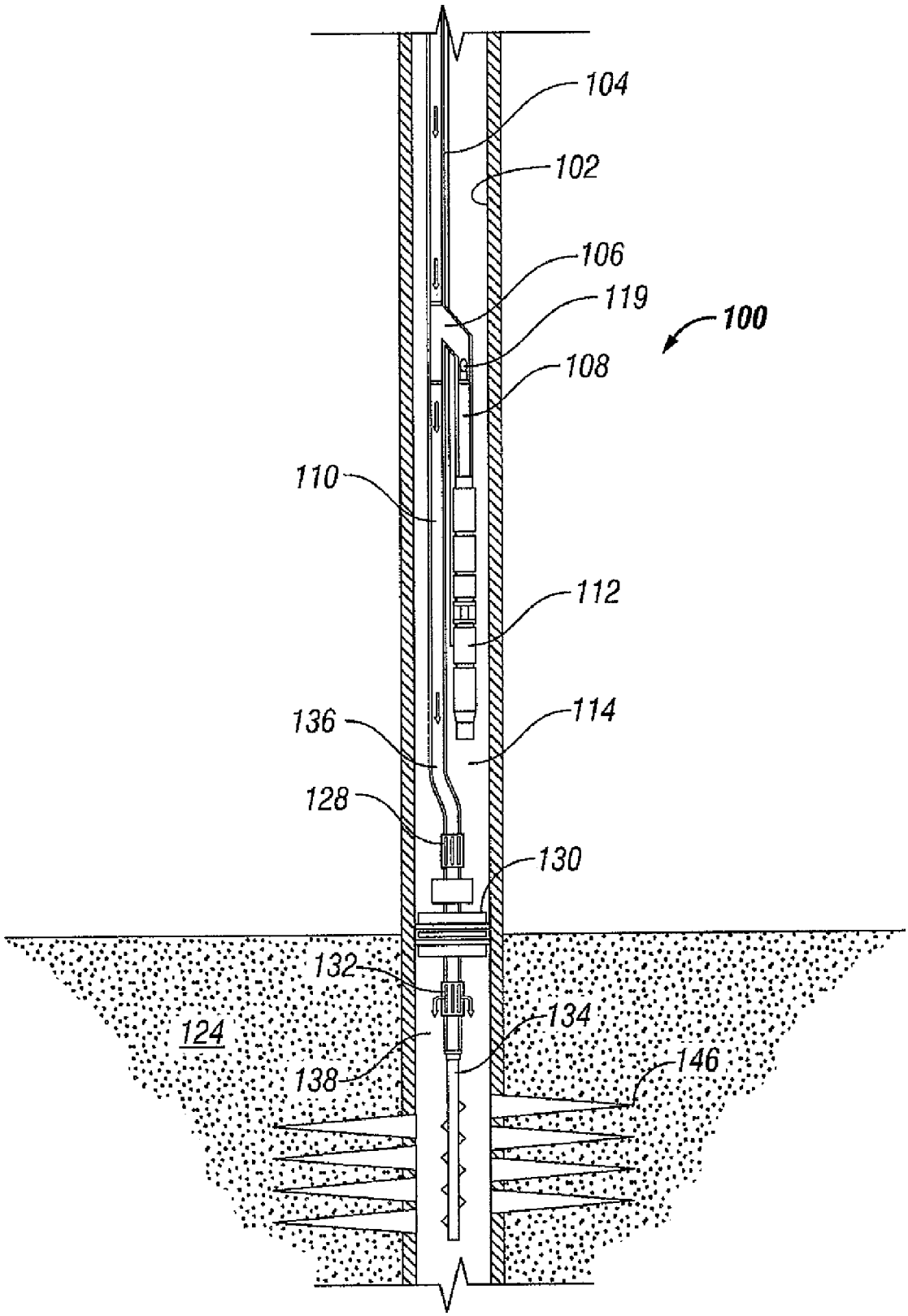
FIG. 4 is a schematic section-view drawing of the production apparatus of FIG. 1 during a chemical injection operation in the wellbore.

Referring now to FIG. 4, the injection of stimulation and neutralization chemicals into perforations 146 of formation at production zone 124 through production apparatus 100 can be described. Following detonation, it may be desirable to inject various chemicals (surfactants, acids, foams, etc.) into the perforated production zone 124 to stimulate or facilitate the flow of hydrocarbons therefrom into cased wellbore at production region 138. Furthermore, following the injection of these chemicals, particularly in the case of acids, neutralizing chemicals must be injected before production pumping can begin. Often, the stimulation and neutralization chemicals are too harsh to come into contact with components of pump assembly 112 without causing damage to delicate seals or other components. Therefore, by opening lower fluid gate 132 and shutting upper fluid gate 128, these chemicals can be injected directly to lower region 138 through production tubing 104 and bypass string 110, past packer 130, and to region 138 through bore 136. Check valve 119 at the top of pump string 108 ensures that the chemicals being injected do not come into contact with pump assembly 112. During these operations, upper zone 114 is hydraulically isolated from lower zone 138 and fluids in production tubing 104. Once stimulation chemicals are neutralized, the resulting combination is able to pass through pump assembly 112 without damaging components thereof. Therefore, following stimulation and neutralization of perforations 146 of production zone 124, production may begin. Furthermore, if fracturing of formation of production zone 124 is desired, it may also be carried out through production apparatus 100 in a manner similar to chemical injection.

Figure 5:
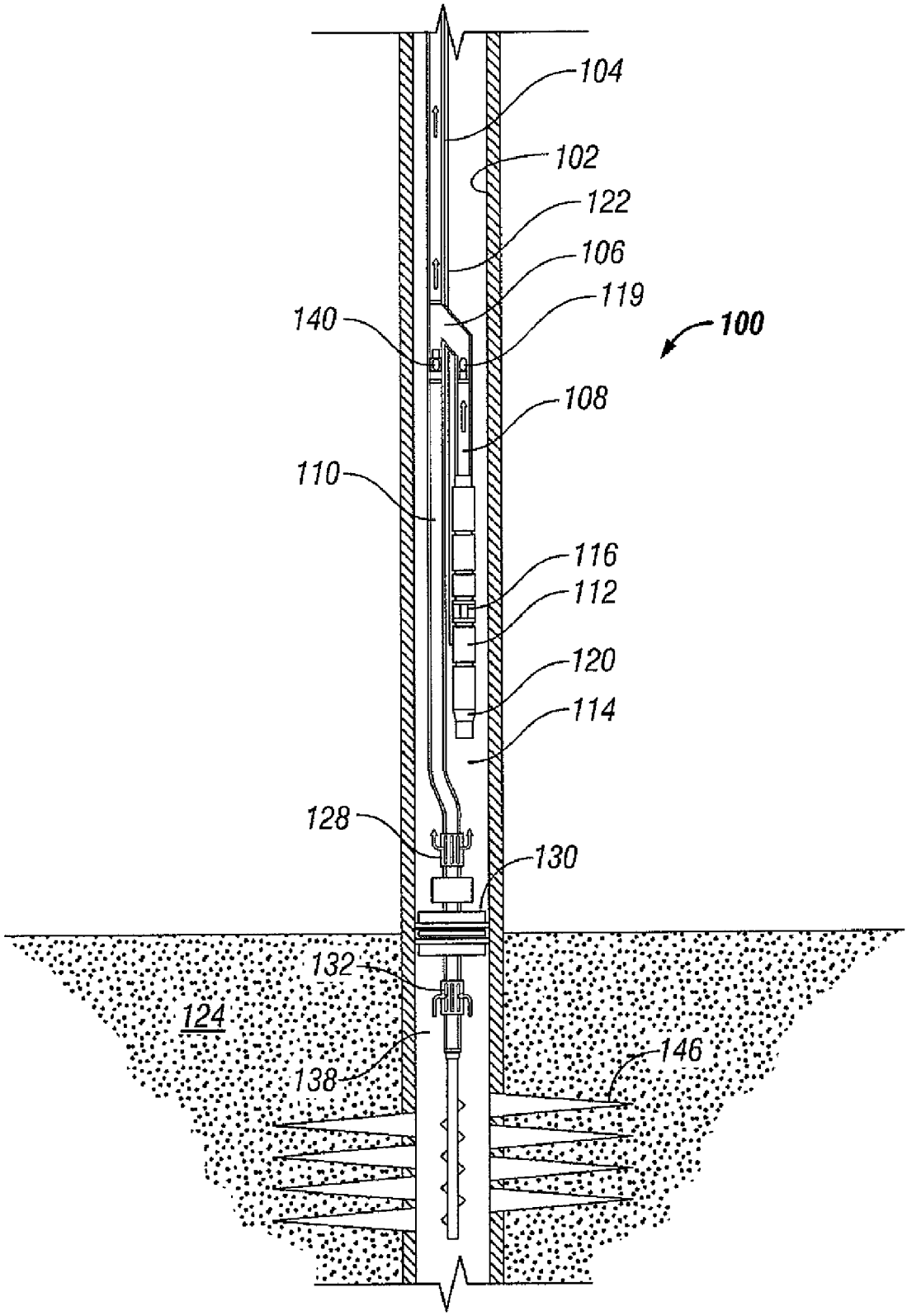
FIG. 5 is a schematic section-view drawing of the production apparatus of FIG. 1 during a production operation in the wellbore.

Referring to FIG. 5, production of hydrocarbons with production apparatus 100 can be described in detail. During production, pump assembly 112 pumps production fluids from lower zone 138 adjacent to production zone 124 to a surface location through production tubing 104. Following perforation and injection of stimulation and neutralization chemicals into production zone 124, production fluids flow into lower zone 138 below packer 130. To retrieve or produce fluids from lower zone 138, upper and lower fluid gates 128, 132 are opened and plug 140 is again re-set in bypass string 110. Pump assembly 112 is then activated and fluids from upper zone 114 are drawn into pump assembly 112 through inlet 116 and pumped up through pump string 108, Y-tool 106, and production tubing 104 to a surface destination. As fluids are removed from upper zone 114 by pump assembly 112, they are replenished by formation fluids entering lower zone 138 through perforations 146. These fluids travel through lower fluid gate 132, across packer 130, and out upper fluid gate 128 to upper zone 114. Because plug 140 prevents bypass string 110 from directly communicating with production tubing 104, pump assembly 112 is able to displace fluids from lower zone 138 to surface location through production tubing 104. Absent plug 140, pump assembly 112 would only circulate fluids between bypass string 110 and upper zone 114.

As described above, pump assembly 112 can optionally be operated through control and power line 122 extending from pump assembly 112 to the surface along production tubing 104. Control and power line 122, if present, preferably provides data communications and electrical or hydraulic power to operate pump assembly 112 from a surface location. Electronics sensor package 120, if present, can optionally be configured to communicate downhole conditions and pump parameters to a surface location through control and power line 122 as well. Furthermore, while control and power line 122 is shown as a line external to the bore of production tubing 104, it should be understood that a control and power line 122 may extend to pump string 108 through the bore of production tubing using connectors and bulkheads known to one of skill in the art. Finally, it should be understood that pump assembly 112 can be of any type and model known in the art of downhole production. While pump assembly 112 can be electrically, mechanically, or hydraulically operated, it will ordinarily be configured as an electrical submersible pump assembly.

Figure 6:
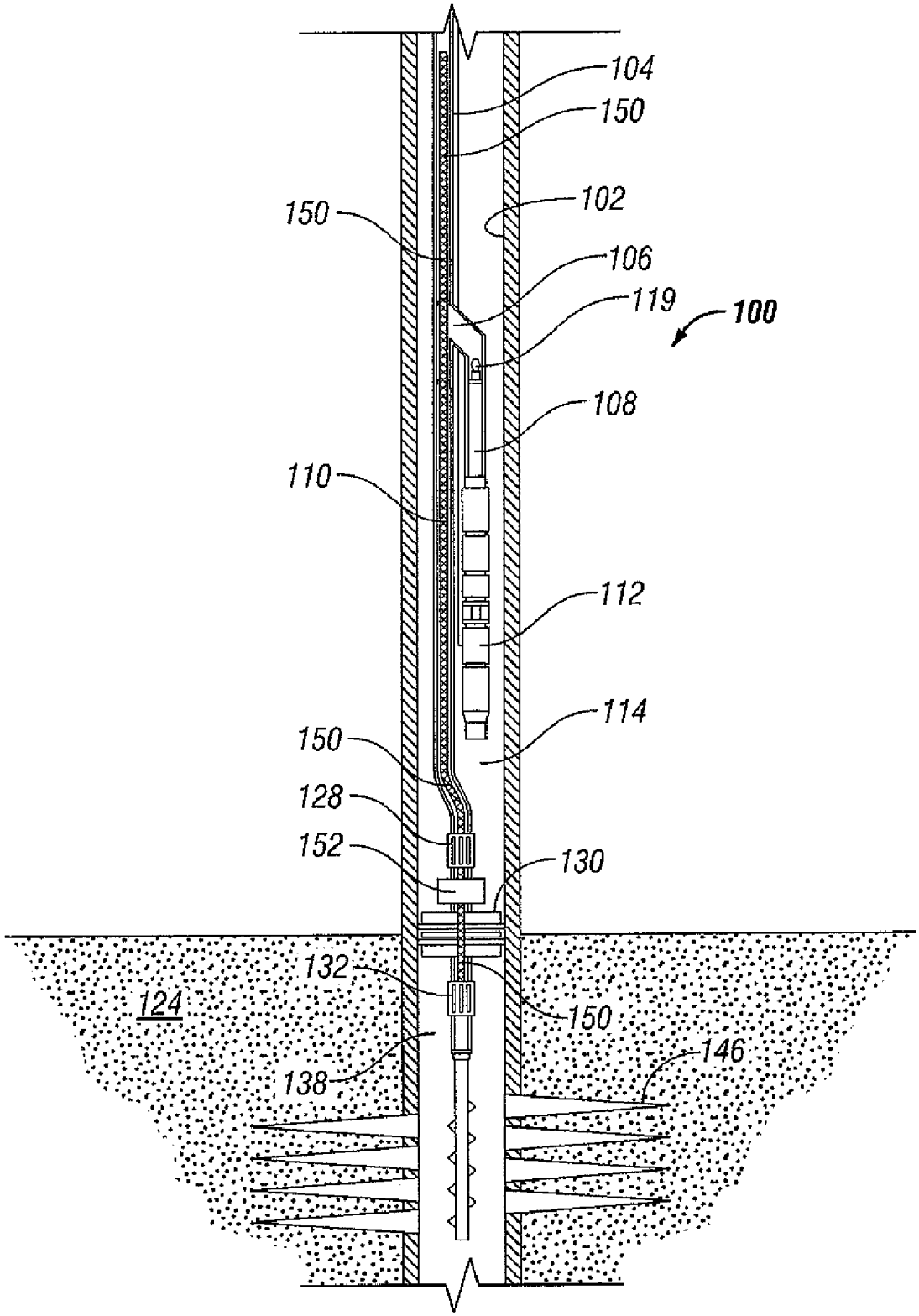
FIG. 6 is a schematic section-view drawing of the production apparatus of FIG. 1 during a workover operation in the wellbore.

Referring to FIG. 6, the ability of production apparatus 100 to be used in performing workover operations is disclosed. In FIG. 6, a work conduit 150 extends from within production tubing 104, through Y-tool 106, through bypass string 110, past upper fluid gate 128, through packer 130, and through lower fluid gate 132. Work conduit 150 is shown schematically as a wireline assembly, but it should be understood that other conduit mechanisms, including, but not limited to, capillary tubing, slickline, fiber-optic line, and coiled tubing can be similarly deployed. Work conduit 150 can be deployed either to take measurements or to perform work operations. Such measurements can include temperature, pressure, density, and resistivity of downhole fluids. Such work operations can include the injection of stimulation chemicals or foams, the manipulation of downhole equipment (e.g. valves), and the cleansing of bores of the production apparatus 100. Furthermore, work conduit 150 can be deployed downhole to interface and communicate with a drill stem testing device 152, if present. Drill stem testing device 152 can be configured to accumulate various fluid and data samples of interest to well operators. Work conduit 150 can be used to retrieve these samples from drill stem testing device 152 and carry them to the surface for analysis.

While production apparatus 100 is shown disposed in wellbore lined with casing 102, it should be understood that an uncased wellbore can also be used in conjunction with production apparatus 100. Furthermore, it should be understood that production apparatus 100 can be deployed without a perforating gun 134 when downhole production zone 124 has already been perforated. A production apparatus 100 without a perforating gun 134 still has the benefit of being a single apparatus capable of injecting and neutralizing chemicals to and producing wellbore fluids from production zone 124 without sacrificing pump assembly 112 integrity. Additionally, production apparatus 100 can be designed for either long-term or short-term emplacement within a wellbore. Once perforating gun 134 is fired and the production zone 124 is stimulated with chemicals, pump assembly 112 can remain in permanent service if so desired. In the event a different production assembly is desired for the wellbore, production apparatus 100 can be retrieved and an alternative production system can be installed.

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. An apparatus to be disposed within a wellbore, the apparatus comprising:

production tubing terminating into a pump string and a bypass string at its distal end;

said pump string configured to pump a wellbore fluid to a surface location through said production tubing;

said bypass string including an upper fluid gate, a packer, and a lower fluid gate;

said upper and said lower fluid gates configured to selectively allow or disallow fluid communication with a bore of said bypass string, wherein said upper fluid gate is positioned above said packer and said lower fluid gate is positioned below said packer; and a check valve positioned between said pump string and said production tubing to prevent fluids from said production tubing from entering said pump string.

2. The apparatus of claim 1 wherein said upper fluid gate includes a sliding sleeve.

3. The apparatus of claim 1 wherein said lower fluid gate includes a sliding sleeve.

4. The apparatus of claim 1 further comprising a plug in said bypass string to prevent said wellbore fluid from communicating with said production tubing without passing through said pump string.

5. The apparatus of claim 1 further comprising a Y-tool to connect said pump string and said bypass string to said production tubing.

6. The apparatus of claim 1 further comprising a drill stem testing assembly in said bypass string.

7. The apparatus of claim 1 further comprising a perforating gun positioned below said lower fluid gate.

8. The apparatus of claim 7 wherein said perforating gun is activated by a weight bar dropped through said production tubing and said bypass string.

9. The apparatus of claim 1 wherein said pump string includes an electric submersible pump.

10. The apparatus of claim 1 wherein said production tubing and said bypass string are configured to allow a work conduit to be engaged therethrough.

11. An apparatus to be disposed within a wellbore, the apparatus comprising:

production tubing terminating into a pump string and a bypass string at its distal end;

said pump string configured to pump a wellbore fluid to a surface location through said production tubing;

said bypass string including an upper fluid gate, a packer, a lower fluid gate, and a perforating gun;

said upper and said lower fluid gates configured to selectively allow or disallow fluid communication with a bore of said bypass string, wherein said upper fluid gate is positioned above said packer and said lower fluid gate is positioned below said packer; and a check valve positioned between said pump string and said production tubing to prevent fluids from said production tubing from entering said pump string.

12. The apparatus of claim 11 wherein said upper fluid gate includes a sliding sleeve.

13. The apparatus of claim 11 wherein said lower fluid gate includes a sliding sleeve.

14. The apparatus of claim 11 further comprising a plug in said bypass string to prevent said wellbore fluid from communicating with said production tubing without passing through said pump string.

15. The apparatus of claim 11 further comprising a Y-tool to connect said pump string and said bypass string to said production tubing.

16. The apparatus of claim 11 further comprising a drill stem testing assembly in said bypass string.

17. The apparatus of claim 11 wherein said perforating gun is activated by a weight bar dropped through said production tubing and said bypass string.

18. The apparatus of claim 11 wherein said production tubing and said bypass string are configured to allow a work conduit to be engaged therethrough.

19. Production tubing to complete a wellbore, comprising:

a Y-tool at a distal end of the production tubing, said Y-tool communicating a bypass string and a pump string with the production tubing;

said pump string configured to pump a wellbore fluid into the production tubing;

said bypass string including an upper fluid gate, a packer, a lower fluid gate, and a perforating gun;

said upper and said lower fluid gates configured to selectively allow or disallow fluid communication with a bore of said bypass string, wherein said upper fluid gate is positioned above said packer and said lower fluid gate is positioned below said packer; and a check valve positioned in said Y-tool between said production tubing and said pump string, said check valve configured to prevent fluids from said production tubing and said bypass string from entering said pump string.

20. The production tubing of claim 19 wherein said upper fluid gate includes a sliding sleeve.

21. The production tubing of claim 19 wherein said lower fluid gate includes a sliding sleeve.

22. The production tubing of claim 19 further comprising a plug in said bypass string to prevent said wellbore fluid from communicating with the production tubing without passing through said pump string.

23. The production tubing of claim 19 wherein said perforating gun is configured to be activated by a weight bar dropped through the production tubing.

24. The production tubing of claim 19 wherein said pump string includes an electric submersible pump.

25. The production tubing of claim 19 wherein the production tubing and said bypass string are configured to allow a work conduit to be engaged therethrough.

26. A method to complete a wellbore with a string of production tubing, the method comprising:

deploying the production tubing to the wellbore, the production tubing terminating at a pump string and a bypass string including an upper fluid gate, a packer, a lower fluid gate, and a perforating gun;

a check valve positioned between the production tubing and the pump string, the check valve configured to prevent fluids from the production tubing and the bypass string from entering the pump string;

expanding the packer to isolate a production zone from the upper fluid gate and the pump string;

opening the upper and lower fluid gates and pumping wellbore fluids from the production zone through the production tubing to create an under-balanced condition;

closing the upper and lower fluid gates and detonating the perforating gun;

opening the lower fluid gate and injecting stimulation and neutralization chemicals to the formation through the production tubing and the bypass string; and opening the upper and lower fluid gates and pumping production fluids from the production zone to the surface through the production tubing.

27. The method of claim 26 wherein the upper fluid gate includes a sliding sleeve.

28. The method of claim 26 wherein the lower fluid gate includes a sliding sleeve.

29. The method of claim 26 further comprising plugging the bypass string.

30. The method of claim 26 further comprising dropping a weight bar through the production tubing and the bypass string to detonate the perforating gun.

31. The method of claim 26 further comprising engaging a work conduit through the production tubing and the bypass string to perform a subsequent operation.

* * * * *